US005722498A

United States Patent [19]

Van Impe et al.

[11] Patent Number: 5,722,498

[45] Date of Patent: Mar. 3, 1998

[54] SOIL DISPLACEMENT AUGER HEAD FOR INSTALLING PILES IN THE SOIL

[75] Inventors: William Frans Van Impe, Erpe-Mere; Guy Adolf August Cortvrindt, Affligem, both of Belgium

[73] Assignee: Hareninvest, Wijnegem, Belgium

[21] Appl. No.: 637,747

[22] PCT Filed: Oct. 28, 1994

[86] PCT No.: PCT/BE94/00078

§ 371 Date: Jun. 17, 1996

§ 102(e) Date: Jun. 17, 1996

[87] PCT Pub. No.: WO95/12050

PCT Pub. Date: May 4, 1995

[30] Foreign Application Priority Data

Oct. 28, 1993 [BE] Belgium ..... 09301168

[51] Int. Cl.[6] ..... F21B 7/26; E02D 5/62; E02D 7/22

[52] U.S. Cl. ..... 175/394; 405/232; 405/241

[58] Field of Search ..... 175/394; 405/232, 405/233, 240, 241

[56] References Cited

U.S. PATENT DOCUMENTS

| | | | |
|---|---|---|---|
| 3,226,855 | 1/1966 | Smith | 175/394 X |
| 3,485,052 | 12/1969 | Turzillo | 175/394 X |
| 4,458,765 | 7/1984 | Feklin et al. | 175/19 |

FOREIGN PATENT DOCUMENTS

| | | | |
|---|---|---|---|
| 0034106 | 8/1981 | European Pat. Off. . | |
| 0228138 | 7/1987 | European Pat. Off. . | |
| 22192 | 5/1921 | France . | |
| 2513284 | 3/1983 | France . | |
| 576831 | 5/1933 | Germany . | |
| 4220976 | 7/1993 | Germany . | |
| 1694849 | 11/1991 | U.S.S.R. | 175/394 |

*Primary Examiner*—David J. Bagnell

*Attorney, Agent, or Firm*—Birch, Stewart, Kolasch & Birch, LLP

[57] ABSTRACT

Soil displacement auger head for installing piles in the soil, having a tip, a displacement body having at least over a lower portion a core diameter increasing in diameter in a direction away from the tip, and at least one screw flange extending at least over the lower portion of the displacement body. To obtain a more efficient displacement, the pitch of the screw flange increases and the core diameter of the displacement body increases preferably discontinuously via a number of transition slopes.

18 Claims, 7 Drawing Sheets

SOIL DISPLACEMENT AUGER HEAD FOR INSTALLING PILES IN THE SOIL

BACKGROUND OF THE INVENTION

1. Field of the Invention

This invention relates to a soil displacement auger head for installing piles in the soil. A tip is provided with a displacement body having at least over a lower portion a core diameter increasing in a direction away from said tip. At least one screw flange extends at least over said lower portion of the displacement body.

2. Description of the Background Art

A soil displacement auger head is disclosed in German patent No. 4 220 976. This known auger head has a relatively long cylindrical portion between the lower portion of the conical displacement body, and the tip. On this cylindrical portion there is provided a screw flange with a constant pitch and a constant outer diameter. To increase the axial penetrating force during screwing, there was proposed in the embodiment according to FIG. 1 of this German patent to extend the screw flange until over the conical portion of the displacement body.

Another soil displacement auger head is known from European patent No. 0 228 138. In this known auger head the screw flange is however situated exclusively on the cylindrical portion between the displacement body and the tip and obviously doesn't extend over the displacement body itself.

SUMMARY AND OBJECT OF THE INVENTION

The invention described hereafter has as object to present an auger head by which the soil can be displaced more efficiently and requires less energy during screwing in, and which allows also to screw through more resistant, in particular more sandy, layers.

To this end, said screw flange has a pitch which increases at least over said lower portion of the displacement body in the direction away from said tip. indeed it has been found surprisingly that, by providing such an increasing pitch, lower torques are required to screw the auger head into the soil.

Concerning a variable pitch of the screw flange, reference can be made to DE-PS-576 831. In the auger head known therefrom the pitch of the screw flange, however, decreases over the displacement body.

In a particular embodiment of the auger head according to the invention the core diameter of the lower portion of the displacement body increases discontinuously according to said screw flange via a predetermined number of transition slopes.

Such a discontinuous diameter increase of the displacement body is already known per se from U.S. Pat. No. 4 458 765. This known auger head has however no clear screw flange, and certainly no screw flange wherein the pitch of which increases.

According to the present invention, the discontinuous diameter increase has been discovered which, in combination with the increase of the pitch of the screw flange, contributes particularly to the reduction of the energy required for making the hole in the soil. The auger head of the present invention may be used during screwing in through resistant, non-cohesive layers.

Preferably, the pitch of said screw flange increases in between two successive discontinuous diameter transitions, each time in such a way that, during screwing in, substantially a same volume of soil is squeezed and transported before each transition slope of the displacement body. This can be illustrated for example on the basis of the relationship:

$$1_i = 1_o \cdot \frac{n(d_m^2 d_o^2) - v(d_i^2 - d_o^2)}{n(d_m^2 - d_i^2)}$$

wherein:

$1_o$ is the pitch at the first transition slope (17);

$1_i$ is the pitch at the i+1$^{st}$ transition slope (17);

n is the rotational speed at which the auger head (1) is to be turned;

v is the vertical penetration speed of the auger head (1) in the soil;

$d_m$ is the maximum core diameter of the displacement body (14);

$d_o$ is the minimum core diameter of the displacement body (14); and $d_i$ is the core diameter before the i+1$^{st}$ transition slope.

Said transition slopes form for example an angle comprised between 20 and 40 degrees, and in particular between 25 and 35 degrees with a tangent plane to the surface of the displacement body after the respective transition slope.

For screwing through incoherent layers, an angle of about 30 degrees was found the most suitable.

A further reduction of the required moments for screwing in through bearing layers can be obtained by arranging the slopes on the lower portion of the displacement body under a predetermined angle with respect to the longitudinal direction of the auger head wherein the predetermined angle is smaller as the core diameter before the concerned transition slope is larger.

BRIEF DESCRIPTION OF THE DRAWINGS

Further particularities and advantages of this soil displacement auger head will become apparent from the following description of some particular embodiments of the auger head according to this invention. This description is only given as an example and is clearly not intended to limit the scope of the invention. The used reference numbers refer to the annexed figures, wherein.

DETAILED DESCRIPTION OF THE PREFERRED EMBODIMENTS

In the Figures the same reference numbers relate to the same or analog elements.

Figure 1:
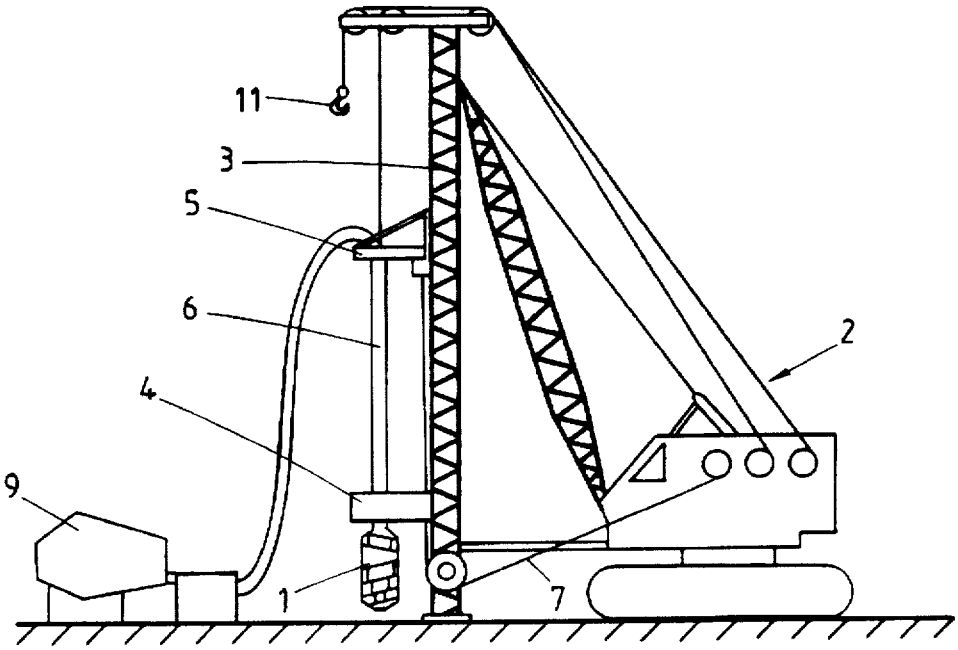
FIG. 1 shows schematically a side view of an equipment for installing piles in the soil by means of an auger head according to the invention.

In FIG. 1 a screwing piling equipment is schematically shown for installing concrete piles in situ in the soil by means of a soil displacement auger head 1 according to the invention.

This screwing piling equipment comprises a crane 2 with a vertical mast 3 provided with an auger motor 4. The auger motor 4 is preferably mounted at the bottom of the mast 3 so that said mast can be constructed as light as possible. Of course, use can also be made of an auger motor 4 which is movable up and down the mast 3.

Figure 2:
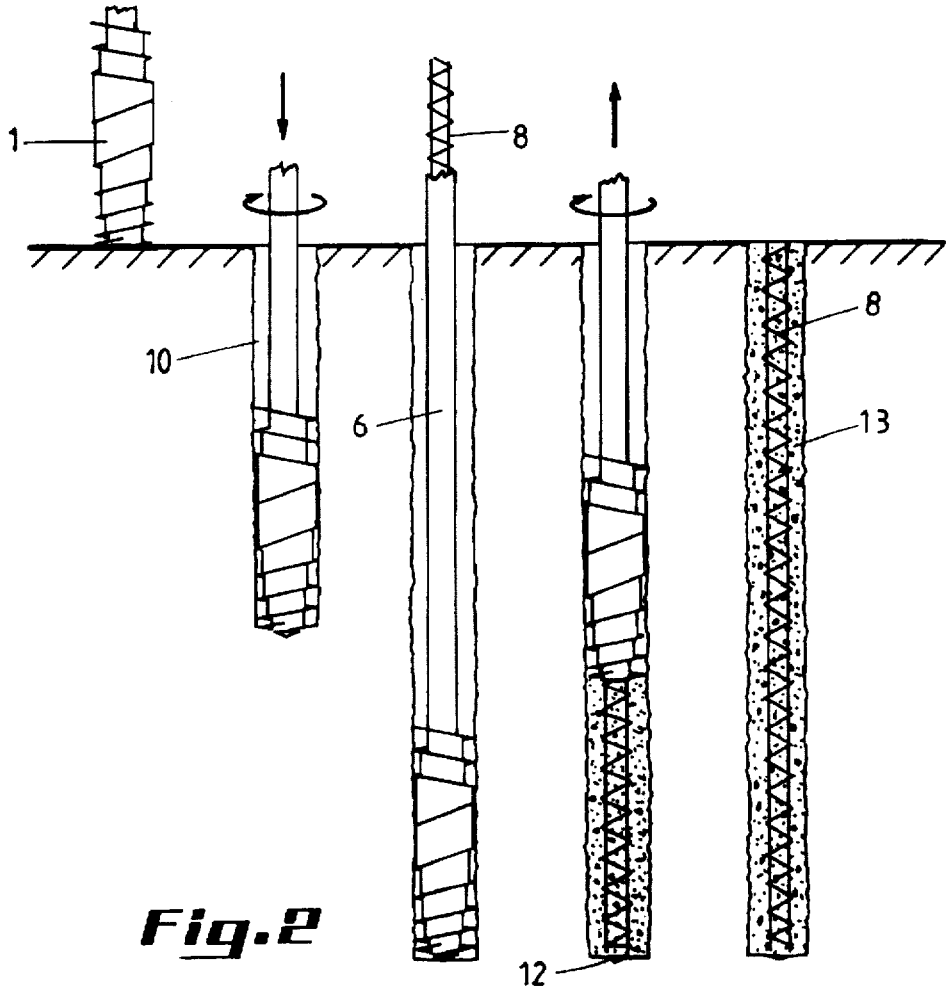
FIG. 2 shows schematically the different steps for installing a pile in the soil by means of the equipment according to FIG. 1.

The different steps for installing a concrete pile in the soil are schematically shown in FIG. 2. In a first step the auger head 1 is screwed through the intermediary of an upwardly and downwardly movable platform 5 and an auger casing 6 in the soil, so that the soil is displaced laterally. Possibly an additional push down can further be exerted onto platform 5 by means of traction ropes 7. Then a reinforcement 8 is put in through the auger tube 6 and pressurized concrete is poured by means of a pump 9 through the auger casing 6 and the auger head 1 in the displaced soil cavity 10, while the latter elements are removed out of this hole 10 by means of the hook 11. At this step, the same rotation direction is maintained as during screwing in. The tip 12 of the auger head 1 remains at the bottom in the soil. If desired the reinforcement 8 may be pushed afterwards in the freshly installed pile 13.

Upon installing the piles 13 in less resistant or weak soils, one sometimes nevertheless has to drill through harder, usually more sandy intermediate layers. Also one has to screw sufficiently far into the bearing layer in order to assure enough bearing capacity for pile 13. Most of the soil displacement auger heads existing at present do not permit screwing through such hard layers or require excessively large penetrating forces. As will become apparent hereinafter, the present invention is directed to, a soil displacement auger head which can be screwed with a more efficient displacement under a reduced penetrating force even through more resistant layers.

In general the auger head 1 according to the invention comprises a tip 12, a displacement body 14 having at least over a lower portion 15 a core diameter increasing in a direction away from said tip and a screw flange 16 extending at least over the lower portion 15 of the displacement body 14. To obtain an axial penetration force which is as large as possible during the screwing in, the screw flange 16 has preferably, at least over the lower portion 15 of the displacement body 14, a substantially constant outer diameter. This auger flange 16 delimits a mainly spiral strip with an increasing core diameter on the displacement body 14.

To achieve the objectives mentioned hereinabove, the invention provides first of all that the screw flange 16 has, over the lower portion 15 of the displacement body 14, a pitch l increasing in the direction away from the tip 12. The increase of this pitch will be described hereafter further in more detail.

In the represented auger head 1 the displacement efficiency is still further increased because, as provided according to a further aspect of the invention, the core diameter of the lower portion 15 of the displacement body 14 increases over said spiral strip discontinuously via a predetermined number of transition slopes 17. It has been found that in this way a more efficient soil displacement can be obtained, especially in resistant, more sandy layers. The result is that smaller forces and/or torques are to be exerted onto the auger head to screw this through such layers, and this notwithstanding the fact that the slopes 17 give at first sight additional resistance.

In an efficient embodiment the discontinuous transition slopes 17 form an angle $\alpha$ comprised between 20 and 40 degrees and preferably between 25 and 35 degrees. The angle $\alpha$ is formed by the tangent plane to the surface of the displacement body 14 after the respective slope 17. In the embodiment according to FIGS. 3 and 4 the angle $\alpha$ comprises about 30 degrees which appeared particularly efficient for screwing through compacted sand layers. In this embodiment four discontinuous transition slopes 17 are provided, regularly divided over the lower portion 15 of the displacement body 14, more particularly each time turned over an angle of 450 degrees. In general, this angle is preferably larger than 360 degrees. At the slopes 17 the core diameter increases with at least 2 cm, preferably with 3 cm to 15 cm and in particular with 4 cm to 10 cm. The number of slopes 17 will depend from the difference between the minimum $d_o$ and the maximum diameter $d_m$ of the displacement body 14.

Between two successive slopes 17 the surface of the auger head 1 may be somewhat conical, but this surface between two successive slopes 17 is preferably cylindrical. Preferably the displacement body 14 extends further substantially up to said tip 12, although an additional portion with a screw flange or not can further be provided between this displacement body 14 and the tip 12.

As already indicated hereinabove, the screw flange 16 has over the lower portion 15 of the displacement body 14 a pitch l increasing in the direction away from the tip 12. The pitch l of the screw flange 16 increases each time between two successive diameter transitions, particularly in such a manner that, during screwing in, substantially the same volume of soil is squeezed and transported before each transition slope 17. The radial displacement of the soil is achieved then mainly at the place of the last discontinuous transition slope 17, in other words before the maximum diameter $d_m$ is reached. Indeed, since the pitch increases each time between two slopes 17, the distance between the top of the slopes 17 and the outer diameter of the screw flange 16 does become smaller, but the successive transition slopes 17 have a larger width, so that the displaced soil is divided at these slopes mainly over a wider area. This is in particular not the case for the first slope 17 unless an increase of the pitch is also provided before this slope; for example placed on a small additional cylindrical part between the displacement body 14 and the tip 12 of the auger head 1. Of course, a certain radial displacement occurs at each slope.

The increase of the pitch of the screw flange 16 may, on the contrary, be continuous. However, preference is given to a discontinuous increase of the pitch as in the shown embodiments. In the embodiment according to FIG. 3, the increase of the pitch is achieved each time at about one rotation after each slope 17, as indicated by means of arrows 18, except of course for the last slope 17. In this way the strip between the different windings of the screw flange 16 starts to diverge thus each time after each slope 17.

In a preferred embodiment, the increase of the pitch $l_i$ over the lower portion 15 of the displacement body 14 is determined on the basis of the following relations:

$$\beta_i = \frac{n(d_m^2 - d_o^2) - v(d_i^2 - d_o^2)}{n(d_m^2 - d_i^2)}$$

wherein $l_o$ is the pitch at the first slope;

$l_i$ is the pitch at the i+1$^{st}$ slope;

n is the rotational speed at which the auger head is to be turned;

v is the vertical penetration speed of the auger head in the intended soil layer;

$d_m$ is the maximum core diameter of the displacement body;

$d_o$ is the minimum core diameter of the displacement body; and $d_i$ is the core diameter before the i+1$^{st}$ slope.

When designing an auger head on the basis of this equation the minimum $d_o$ and the maximum diameter $d_m$ of the displacement body are first of all determined as a function of the pile diameter to he achieved. Further, the number of slopes necessary for this diameter increase is also determined. Then the pitch $l_o$ at the first slope is determined and also the rotational speed n, all as a function of the desired vertical penetration speed. Of course the power of the auger engine 4 will have to he taken into account because a larger pitch $l_o$ and a higher rotational speed require a higher power. On the basis of the pitch $l_o$ and the rotational speed n, the theoretical vertical penetration speed can be determined. The real penetration speed v will be at the most equal to this theoretical value and can be determined more exactly on the basis of experimental data. Since the auger head according to this invention is especially provided to penetrate through resistant sand layers, the optimal penetration speed v is determined experimentally for such layers. Furthermore, account has to be taken in this respect of the fact that possibly an additional downward force can be applied onto the auger head.

Figure 3:
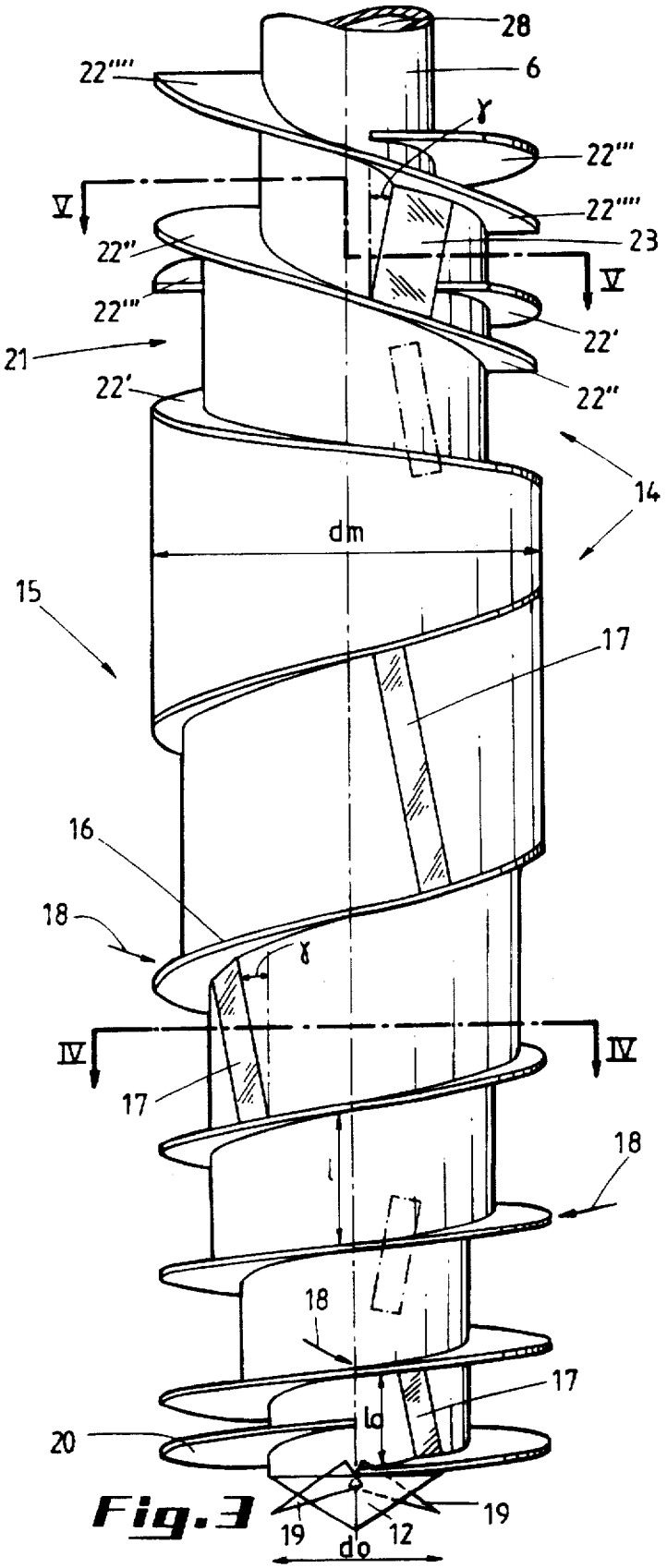
FIG. 3 shows a side view of a soil displacement auger head according to the invention.
Figure 4:
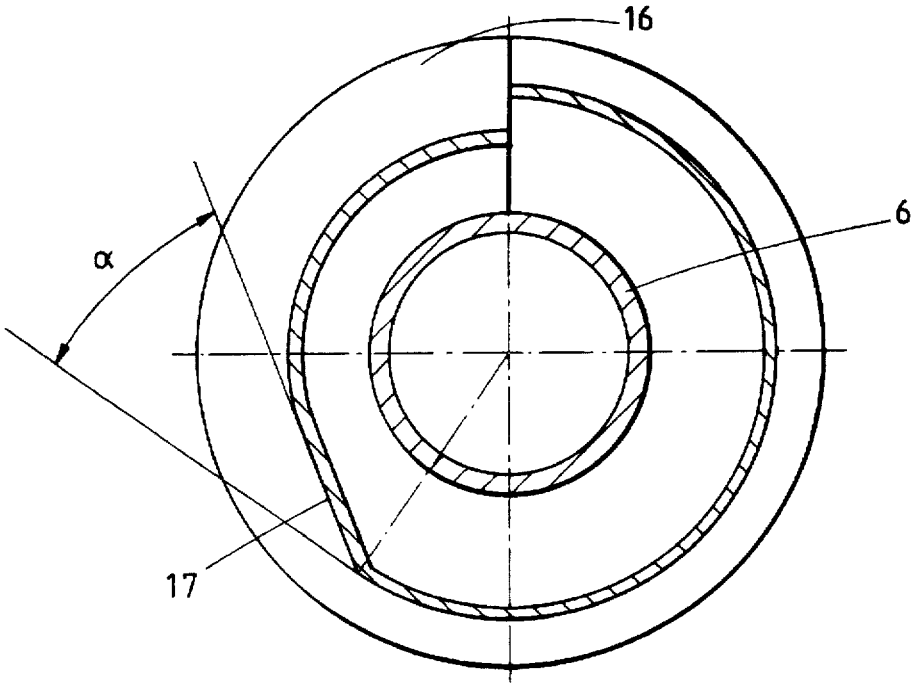
FIGS. 4 and 5 show respectively on a larger scale a cross section according to lines IV—IV and V—V in FIG. 3.
Figure 10:
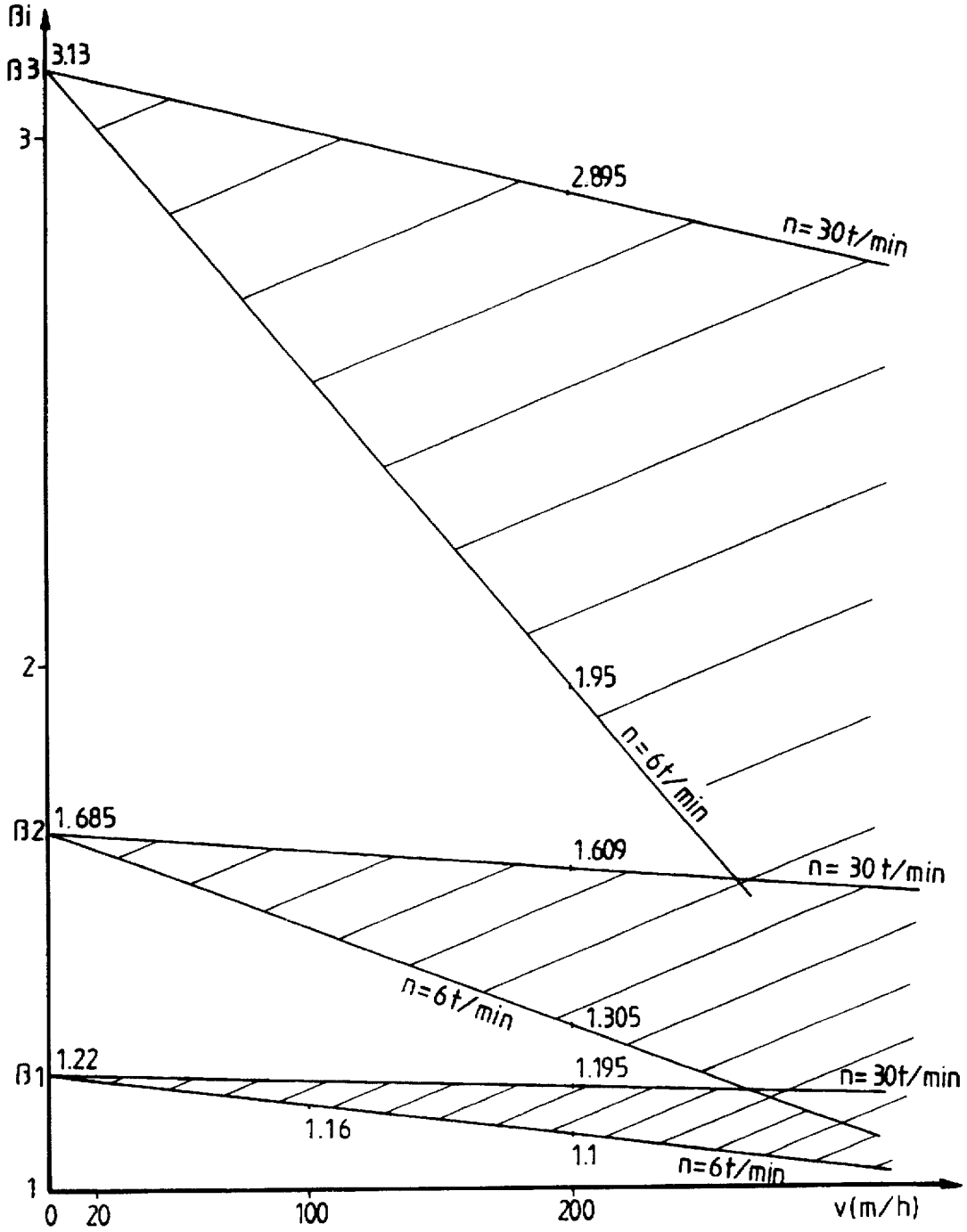
FIG. 10 shows the increase of the pitch of the screw flange of the auger head according to FIG. 3 as a function of a number of variables.

On the basis of this equation the relation between the pitch increases β1, β2, β3 for the three last slopes of the embodiment according to FIG. 3 and the real penetration speed v is given in FIG. 10 and this for a rotational speed of 6 and 30 rpm and for a minimum diameter $d_o$ of 21 cm and a maximum diameter $d_m$ of 46 cm.

Figure 6:
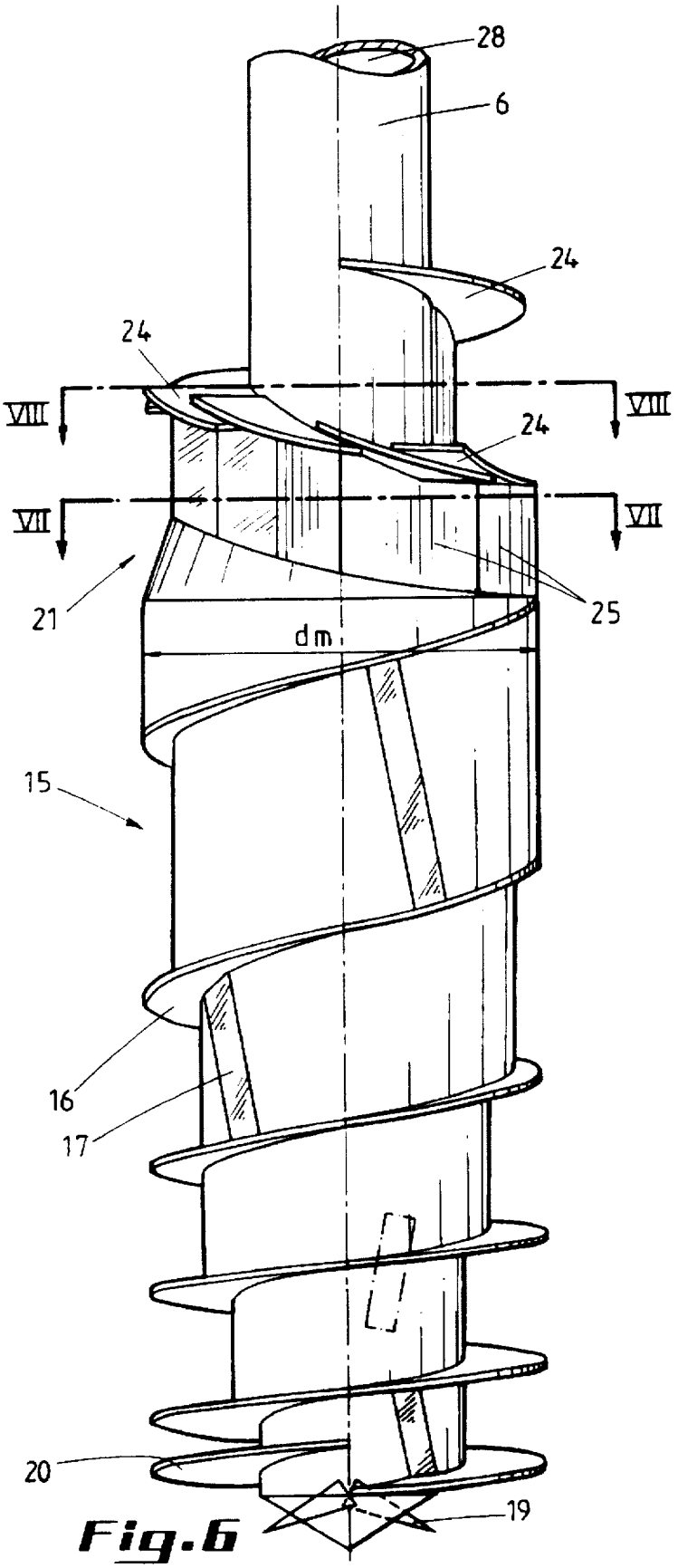
FIG. 6 shows a side view of a soil displacement auger head according to a variant embodiment of FIG. 3.

As it appears from FIGS. 3 and 6, the slopes 17 on the lower portion 15 of the displacement body 14 are preferably directed downwards each under a predetermined angle γ with respect to the longitudinal direction of the auger head 1. This predetermined angle γ further decreases as the respective slope is further removed from tip 12. Due to such an orientation of the discontinuous transition slopes 17 the required penetration force can be reduced further.

In a specific embodiment, the transition slope 17 which is the closest to the tip 12 forms an angle γ of 0 to 20 degrees and preferably of 5 to 10 degrees with the longitudinal direction of the auger head 1 while the slope which is the farthest removed from the tip 12 forms an angle of 0 to 5 degrees with this longitudinal direction. The possible transition slopes 17 situated between the first and the last slope form then an angle of an intermediate value.

On the front of tip 12 of the auger head 1, teeth 19 may further be provided for grinding the soil. The embodiment according to FIG. 3 comprises two teeth 19, one of which being fixed onto the screw flange 16 and the other on an additional screw flange part 20, which terminates already before the first slope 17. The tip 12 itself is, in the usual way, removably mounted onto the auger head 1 in such a manner that it remains in the soil upon screwing the auger head 1 out as a result of the concrete injected under an over pressure in the auger head 1. The auger tip can also be fastened to the auger in such a way that it can be recuperated, for example hingedly between an open and a closed position.

Figure 5:
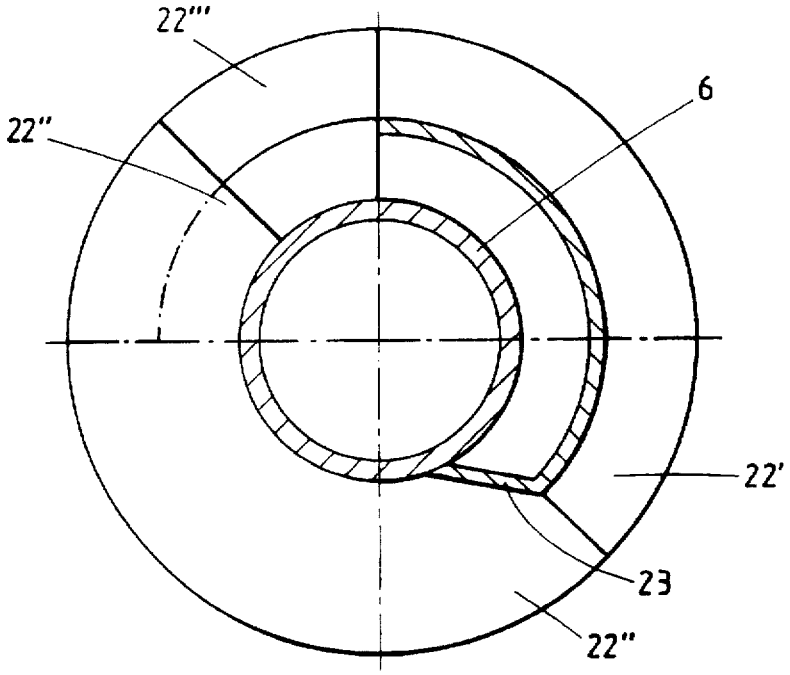

In order to displace again laterally any possible soil situated on top of the auger head, during screwing the auger head 1 out, the displacement body 14 has in the embodiment according to FIG. 3 an upper portion 21 with a core diameter decreasing in the direction away from said tip. This upper portion comprises further four screw flange parts 22', 22", 22'" and 22"", each extending over about 225 degrees and overlapping each other over about 45 degrees, as it appears from FIG. 5. Since the screw flange parts 22 have a screw direction opposite to the screw direction of the screw flange 16, these screw flange parts 22 will provide that, during screwing the auger head out, the soil situated on top of this auger head, will be displaced once again by the upper portion 21 of the displacement body 14. During screwing in, the division in the screw flange parts 22 permits any possible soil which nevertheless would penetrate above the displacement body 14, to escape between these screw flange parts 22 so that no stop is formed which could hamper the operation of the auger head.

Preferably, the upper portion 21 of the displacement body 14 has also a core diameter decreasing discontinuously via a predetermined number of transition slopes 23. Contrary to the transition slopes 17 on the lower portion 15 these transition slopes 23 are in particular directed upwardly under a predetermined angle γ with respect to the longitudinal direction of the auger head 1, more particularly under an angle γ of 0 to 30 degrees and preferably under an angle of 10 to 15 degrees.

In the variant embodiment according to FIG. 6, the upper portion 21 of the displacement body 14 comprises first of all a series of fins 24, in this case eight, overlapping each other partially. These fins 24 are disposed according to a screw direction opposite to the screw direction of the screw flange 16 and extend in particular over about one turn around the auger head 1. The use of mutually overlapping fins 24 offers also in this embodiment the advantage that upon screwing in soil can escape between these used fins 24 reducing once more the penetration energy.

Figure 7:
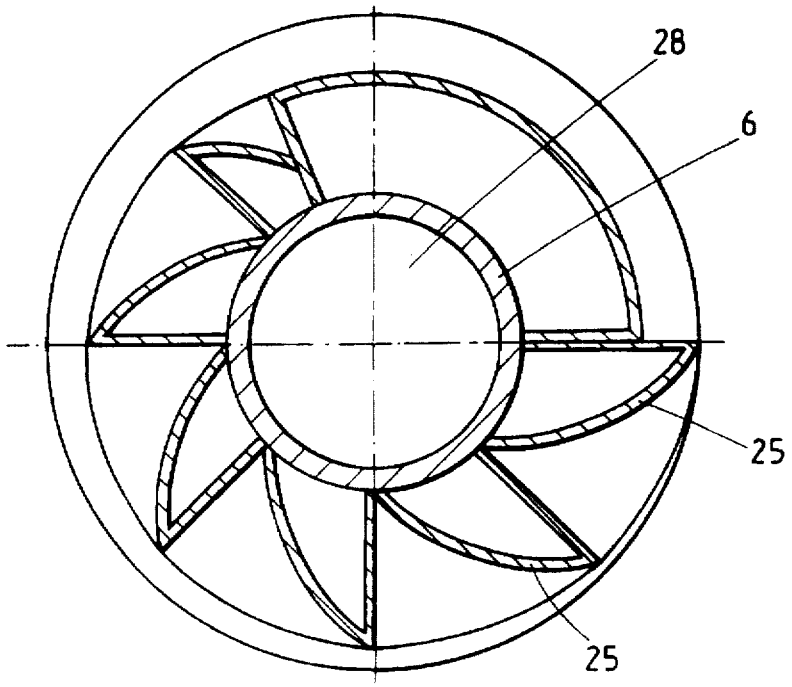
FIGS. 7 and 8 show respectively on a larger scale a cross section according to lines VII—VII and VIII—VIII in FIG. 6.
Figure 8:
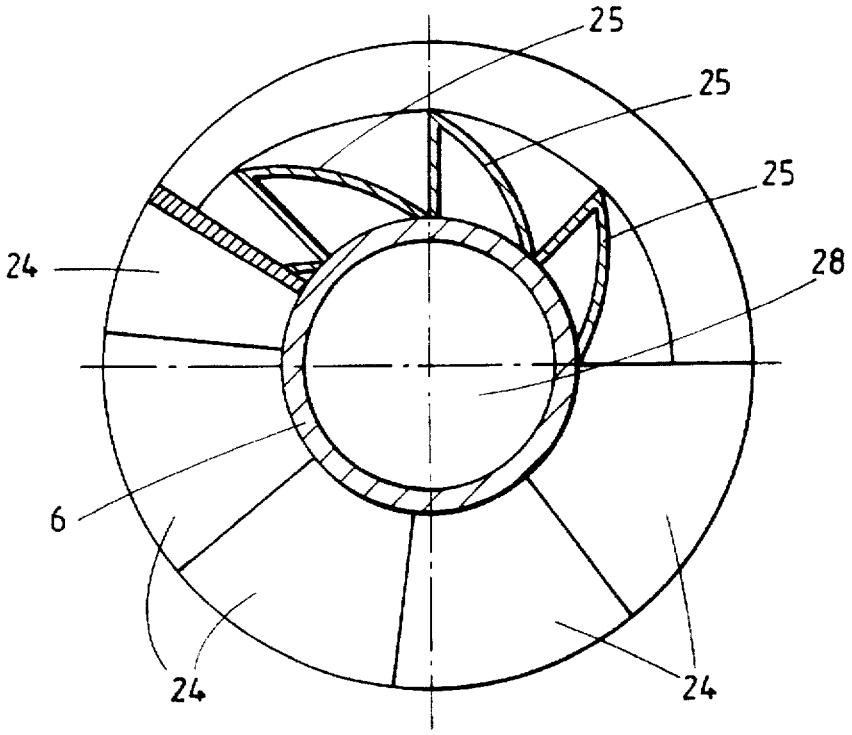

For displacing the soil radially when screwing the auger head 1 out, an inclined displacement surface 25 is arranged underneath each of the fins 24. Starting from the displacement surface 25 which is situated underneath the fins 24 and which is the farthest removed from the tip 12, each of these displacement surfaces 25 project further radially. In this way the displacement surface 25, which is situated underneath the fin 24, which is the closest to the tip 12, extends to about the maximum diameter $d_m$ of the displacement body 14. In this way the soil is also displaced to a further extent radially by each of the successive displacement surfaces 25. As it appears from FIGS. 7 and 8 these displacement surfaces 25 are preferably curved.

Figure 9:
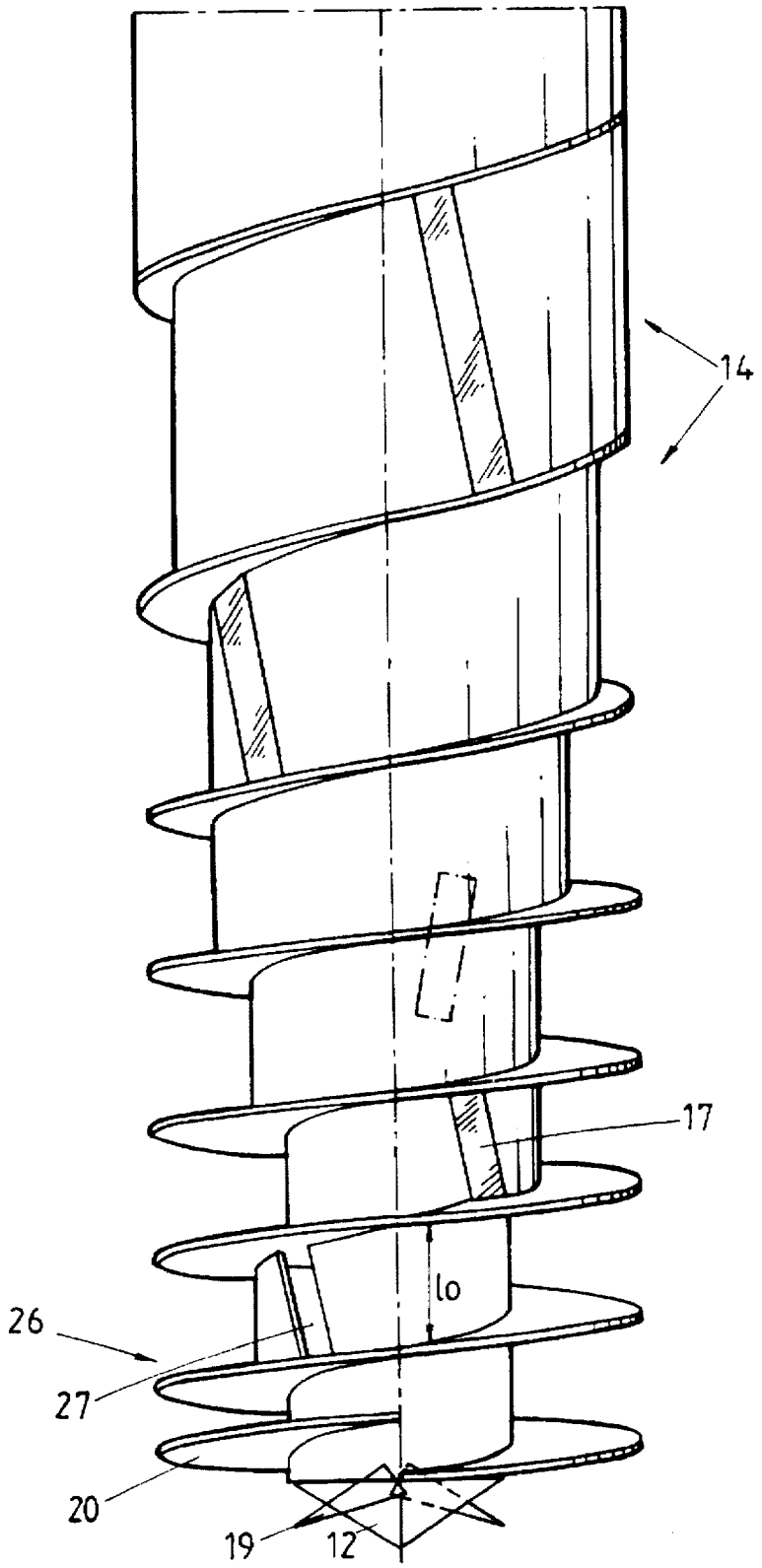
FIG. 9 shows a side view of a soil displacement auger head, more particularly of its lower portion, according to another variant embodiment of FIG. 3 or 6.

In the embodiment according to FIG. 9, an additional part 26 with at least one lateral opening 27 of a concrete duct 28 extending through the auger head 1 is provided between the displacement body 14 and the tip 12 of the auger head 1. Before this lateral opening 27 the auger head 1 has preferably an increasing core diameter which decreases discontinuously at the opening 27. In this way the soil is displaced laterally before the opening during screwing in so that at the opening 27 a space arises in the soil which can be filled up via this opening 27 with pressurized concrete. During screwing in, concrete is pumped through the auger tube and escapes under pressure through this opening. The so introduced concrete is mixed somewhat with the squeezed soil and together the mixture is laterally displaced in the surrounding soil, as the displacement body continues its downward movement so that a reinforced contact wall pile-soil is obtained.

From the previous description it will be clear that the invention is not limited to the embodiments described herein before, but that all kinds of detailed modifications could be applied thereto, for example concerning the shape and the arrangement of the different components of the auger head, without leaving the scope of this invention.

The outer diameter of the screw flange 16 could possibly be larger than the maximum core diameter $d_m$ of the lower portion of the displacement body 14. In this case the upper portion 21 of the displacement body 14 has, in particular in the embodiment according to FIG. 6, then preferably also a maximum core diameter which is substantially equal to the outer diameter of the screw flange 16. In this way, a larger part of the soil can penetrate between the fins 24 during screwing in, till above the auger head 1, whereby less energy is required during screwing in. When screwing out, which clearly requires obviously less energy, this soil can be displaced further radially.

We claim:

1. A soil displacement auger head for installing piles in the soil, comprising:

a tip;

a displacement body having at least over a lower portion a core diameter increasing in diameter in a direction away from said tip; and at least one screw flange extending at least over said lower portion of the displacement body;

wherein said screw flange has a pitch which increases at least over said lower portion of the displacement body in the direction away from said tip.

2. The auger head according to claim 1, wherein the core diameter of the lower portion of the displacement body increases discontinuously according to said screw flange via a predetermined number of transition slopes.

3. The auger head according to claim 2, wherein the pitch of said screw flange increases in between two successive diameter transitions, each time in such a way that, during screwing in, substantially a same volume of soil is squeezed and transported before each transition slope of the displacement body.

4. The auger head according to claim 2, wherein the increase of said pitch is defined on the basis of the following relation:

$$1_i = 1_o \cdot \frac{n(d_m^2 d_o^2) - v(d_i^2 - d_o^2)}{n(d_m^2 - d_i^2)}$$

wherein:

$1_o$ is the pitch at the first transition slope (17);

$1_i$ is the pitch at the $i+1^{st}$ transition slope (17);

n is the rotational speed at which the auger head (1) is to be turned;

v is the vertical penetration speed of the auger head (1) in the soil;

$d_m$ is the maximum core diameter of the displacement body (14);

$d_o$ is the minimum core diameter of the displacement body (14); and $d_i$ is the core diameter before the $i+1^{st}$ transition slope.

5. The auger head according to claim 2, wherein said transition slopes form an angle α comprised between 20 and 40 degrees, preferably between 25 and 35 degrees and in particular an angle α of about 30 degrees with a tangent plane to the surface of the displacement body after the respective transition slope.

6. The auger head according to claim 2, wherein at said transition slopes the core diameter of the displacement body increases with at least 2 cm, preferably with 3 cm to 15 cm and in particular with 4 cm to 10 cm.

7. The auger head according to claim 2, wherein the displacement body has a substantially cylindrical surface between two successive transition slopes.

8. The auger head according to claim 2, wherein said transition slopes on the lower portion of the displacement body are directed downwards each under a predetermined angle γ with respect to the longitudinal direction of the auger head, said predetermined angle γ being smaller as the core diameter before the concerned transition slope is larger.

9. The auger head according to claim 8, wherein the transition slope which is the closest to said tip forms an angle γ of 0 to 20 degrees and preferably of 5 to 10 degrees with the longitudinal direction of the auger head while the transition slope which is the farthest removed from said tip forms an angle γ of 0 to 5 degrees with this longitudinal direction.

10. The auger head according to claim 1, wherein said screw flange has a substantially constant outer diameter at least over the lower portion of the displacement body.

11. The auger head according to claim 1, wherein said displacement body has over an upper portion a core diameter which decreases in the direction away from said tip, this upper portion comprising at least two screw flange parts each extending over at least half of the circumference of the displacement body, at the most over the perimeter of this displacement body, and overlapping each other partially and having a screw direction opposite to the screw direction of the screw flange on the lower portion of the displacement body.

12. The auger head according to claim 11, wherein said screw flange parts extend over 200 to 250 degrees of the circumference of the displacement body, in particular over about 225 degrees of this circumference, and overlap each other over 35 to 55 degrees of this circumference, in particular over about 45 degrees.

13. The auger head according to claim 11, wherein said upper portion of the displacement body has a core diameter which decreases discontinuously via a predetermined number of transition slopes.

14. The auger head according to claim 1, wherein said displacement body has an upper portion comprising a series of fins disposed according to a screw direction which is opposite to the screw direction of the screw flange on the lower portion of the displacement body and extending preferably over about one turn around the circumference of the displacement body, which fins overlap each other partially, an inclined displacement surface being arranged underneath each of these fins for displacing the soil radially.

15. The auger head according to claim 14, wherein from the displacement surface which is situated underneath the fin, the farthest removed from the tip, each of said displacement surfaces extend further radially, so that the displacement surface, situated underneath the fin and the closest to the tip 12, extends substantially up to the maximum core diameter of the displacement body.

16. The auger head according to claim 1, wherein between said tip and the displacement body the auger head has from this tip an increasing core diameter which then decreases discontinuously, an opening of a concrete duct through the auger head, debouching to the outside at this discontinuous decrease.

17. A soil displacement auger had for installing piles in the soil, comprising:

a tip;

a displacement body having at least over a lower portion a core diameter increasing in a direction away from said tip; and at least one screw flange extending at least over said lower portion of the displacement body;

wherein said screw flange has a pitch which increases at least over said lower portion of the displacement body in the direction away from said tip and the core diameter of the lower portion of the displacement body increases discontinuously according to said screw flange via a predetermined number of transition slopes.

18. A soil displacement auger had for installing piles in the soil, comprising:

a tip;

a displacement body having at least over a lower portion a core diameter increasing in a direction away from said tip; and at least one screw flange extending at least over said lower portion of the displacement body;

wherein said screw flange has a pitch which increases at least over said lower portion of the displacement body in the direction away from said tip and said displacement body has over an upper portion a core diameter which decreases in the direction away from said tip, this upper portion comprising at least two screw flange parts each extending over at least half of the circumference of the displacement body, at the most over the perimeter of this displacement body, and overlapping each other partially and having a screw direction opposite to the screw direction of the screw flange on the lower portion of the displacement body.

* * * * *